United States Patent [19]

Berner et al.

[11] Patent Number: 4,806,820

[45] Date of Patent: Feb. 21, 1989

[54] MASK-FRAME ASSEMBLY AND METHOD OF MANUFACTURING THE SAME

[75] Inventors: Dietrich Berner, Uhingen; Rolf Reidinger, Deizisau; Rainer Vollath, Esslingen, all of Fed. Rep. of Germany

[73] Assignee: Alcatel NV, Stuttgart, Fed. Rep. of Germany

[21] Appl. No.: 147,523

[22] Filed: Jan. 25, 1988

Related U.S. Application Data

[63] Continuation of Ser. No. 364,178, Apr. 1, 1982, abandoned.

[30] Foreign Application Priority Data

Apr. 18, 1981 [DE] Fed. Rep. of Germany ..... 3115799

[51] Int. Cl.[4] ..... H01J 29/07

[52] U.S. Cl. ..... 313/404; 313/407; 445/37

[58] Field of Search ..... 313/402, 404, 405, 406, 313/407; 445/37, 45, 47

[56] References Cited

U.S. PATENT DOCUMENTS

| | | | |
|---|---|---|---|
| 3,351,996 | 11/1967 | Fiore | 445/47 X |
| 3,368,098 | 2/1968 | Denny | 313/407 |
| 4,099,086 | 7/1978 | Röder et al. | 313/407 |
| 4,308,485 | 12/1981 | Ignazio | 313/407 |

FOREIGN PATENT DOCUMENTS

| | | | |
|---|---|---|---|
| 2220229 | 11/1972 | Fed. Rep. of Germany . | |
| 2602240 | 1/1976 | Fed. Rep. of Germany | 313/407 |

*Primary Examiner*—David K. Moore
*Assistant Examiner*—K. Wieder
*Attorney, Agent, or Firm*—Peter C. Van Der Sluys

[57] ABSTRACT

The invention relates to a mask-frame assembly for use as a color-selecting-electrode system in a color-television tube. The structure features of the mask allow for a simplified method of manufacturing such an assembly. The mask and frame are subjected to a common surface treatment in accordance with a particular temperature program after joining them together at given points by spot welding.

7 Claims, 2 Drawing Sheets

MASK-FRAME ASSEMBLY AND METHOD OF MANUFACTURING THE SAME

This application is a continuation of Ser. No. 364,178 filed Apr. 1, 1982, now abandoned.

BACKGROUND OF THE INVENTION

1. Field of the Invention

The present invention relates to a mask-frame assembly for use in a color-selecting-electrode system in color-television tubes, and to a method of manufacturing the same.

2. Description of the Prior Art

In a color-television tube of conventional design, the three electron beams must strike exactly their assigned red, green, and blue phosphor areas on screen. The necessary angle-dependent assignment of the phosphor areas to the electron beams is achieved by means of the so-called mask. For every trio of phosphor areas on the screen, there is one aperture in the mask, which is just behind the screen and parallel to it.

The requirements placed on the positional and dimensional accuracy of such a mask are very stringent, for the proper mask-screen relationship must be achieved over the entire area of the mask during production and then maintained over the whole life of the tube. In particular, there must be no change in position due to the temperature rise when the set is turned on. The resulting requirements can only be fulfilled by optimizing the design of the product and the manufacturing technology used, so that comparatively high costs are incurred.

In conventional methods, the mask and its frame are assembled after being blackened separately, so that dimensional changes due to the temperature of about 600° C. during blackening can be largely compensated for during assembly. After being assembled by spot welding, the mask-frame assembly is stabilized at about 450° C. to reduce internal stresses in the material which were caused by the welding process. The two thermal treatments of the mask and the frame in separate operations and facilities involve high handling costs and require two furnace installations. The separate stacking of masks and frames during the thermal treatments very easily results in distortion of the masks and frames under their dead weight, so that the masks and frames cannot be stacked to save factory space and reduce the amount of equipment required. When the mask and the frame are welded together and the mounting springs are welded on, splashes of welding flux are unavoidable because the surfaces had become poor conductors during the blackening process. Another disadvantage is that the hitherto used maximum temperature during blackening results in a high subsequent deformation ("collapsing") of the mask.

SUMMARY OF THE INVENTION

The aim of the invention is to make such a fabrication process simpler and, thus, more economical. This is achieved by an improvement in design which allows for simplification of the fabrication process. The invention centers on the operations necessary to blacken the mask and the frame supporting it, which may also be called "surface passivation" and serves primarily to prevent corrosion of the sheet iron used, make the surfaces non-reflecting, and ensure good heat-radiating capacity.

Accordingly, the object of the invention is to provide a simplified manufacturing method which does not have the above disadvantages, and a design of the mask-frame assembly which is suitably improved, particularly with regard to the novel manufacturing method.

It was found that the main requirements determining the sequence of operations in the conventional fabrication process are no longer imperative if, according to the invention, the following technical instructions are followed.

The positions of the welds must be chosen so that the internal stresses in the material caused during or remaining after the thermal treatment are taken up by permissible deformations which remain within the elastic range. Notches, recesses, and creases must be formed to provide stress relief. If these requirements are followed, the mask is allowed to optimally compensate for thermal expansion toward all sides without being curved too much, so that the maximum change in position remains sufficiently small when a joint thermal treatment of the mask-frame assembly is carried out.

DESCRIPTION OF THE INVENTION

Figure 1:
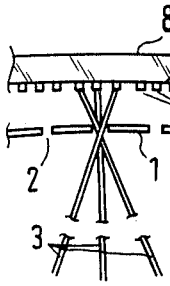
FIG. 1 shows schematically the operation of a shadow mask.
Figure 2:
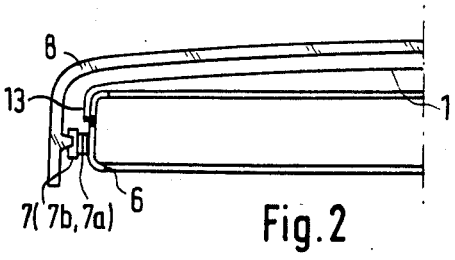
FIG. 2 shows the assembly of the shadow mask, frame and television tube faceplate.

Referring to FIG. 1, there is shown schematically the operation of a shadow mask 1 having apertures 2 through which electron beams 3 strike selected phosphor areas 4 formed on an inner surface 5 of a faceplate 8. FIG. 2 shows the shadow mask 1 having a flange 13 mounted to a frame 6. Frame 6 is provided with connecting members 7 consisting of bimetallic spring holders 7*a* and mounting springs 7*b*. The connecting members 7 function to mount the shadow mask frame assembly within the faceplate 8 of a television tube.

Figure 3:
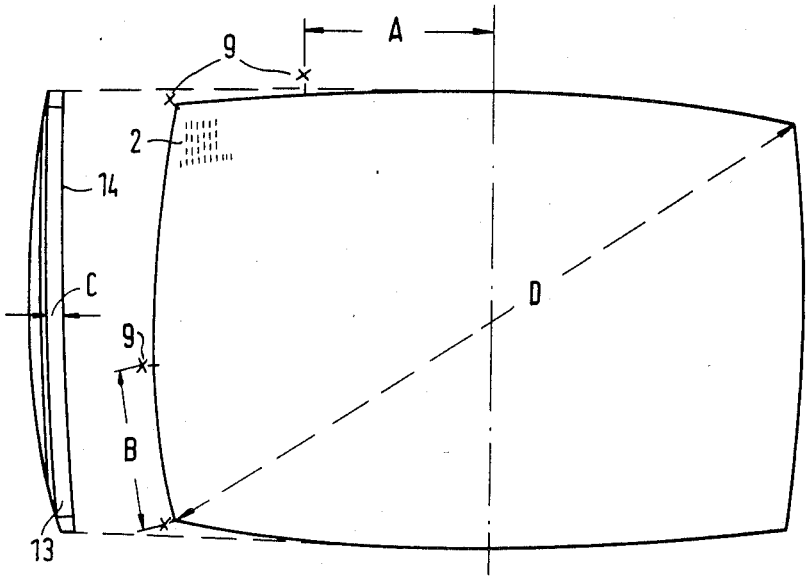
FIG. 3 shows the distribution of the welds along the flange of the shadow mask.
Figure 4A:
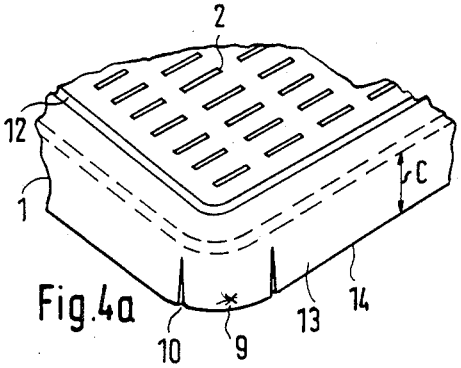
FIGS. 4*a* and 4*b* show how the welds are stress-relieved by indentations or cutouts.
Figure 4B:
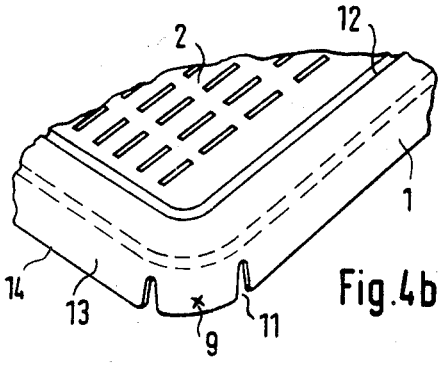
Figure 5:
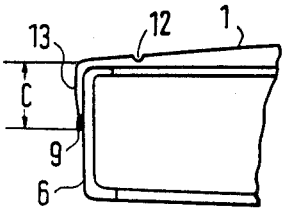
FIG. 5 is a cross-sectional view of the mask and frame.

Referring to FIGS. 4*a*, 4*b* and 5, the shadow mask 1 is shown to have indentations 10 as shown particularly in FIG. 4*a* or cutouts 11 as shown particularly in 4*b* formed in the flange 13 for the purpose of stress relief. In addition, a crease 12 is formed about the periphery of the shadow mask for the purpose of compensating for thermal expansion. The location of welds 9 along the flange 13 of mask 1 for attaching the mask to the frame 6 are shown in FIG. 3.

Referring specifically to FIG. 3, the distance A between the center of the long side of the mask and the nearest weld 9 is chosen so that D/4.5 is less than or equal to A, which is less than or equal to D/2.4 where D is the diagonal dimension across the shadow mask. On the short side of the mask, the distance B between the weld 9 and the nearest corner of the mask is chosen so that D/8.4 is equal to or less than B, which is equal to or less than D/3.0. The width C of the flange 13 near the edge 14 on which the welds are located is chosen so that C is equal to or greater than 1.6D/100.

The welds 9 at the corners of the mask are relieved of mmechanical stress by the stress release means 10 or 11 formed on each side of said weld as shown in FIGS. 4*a* and 4*b*.

Figure 6:
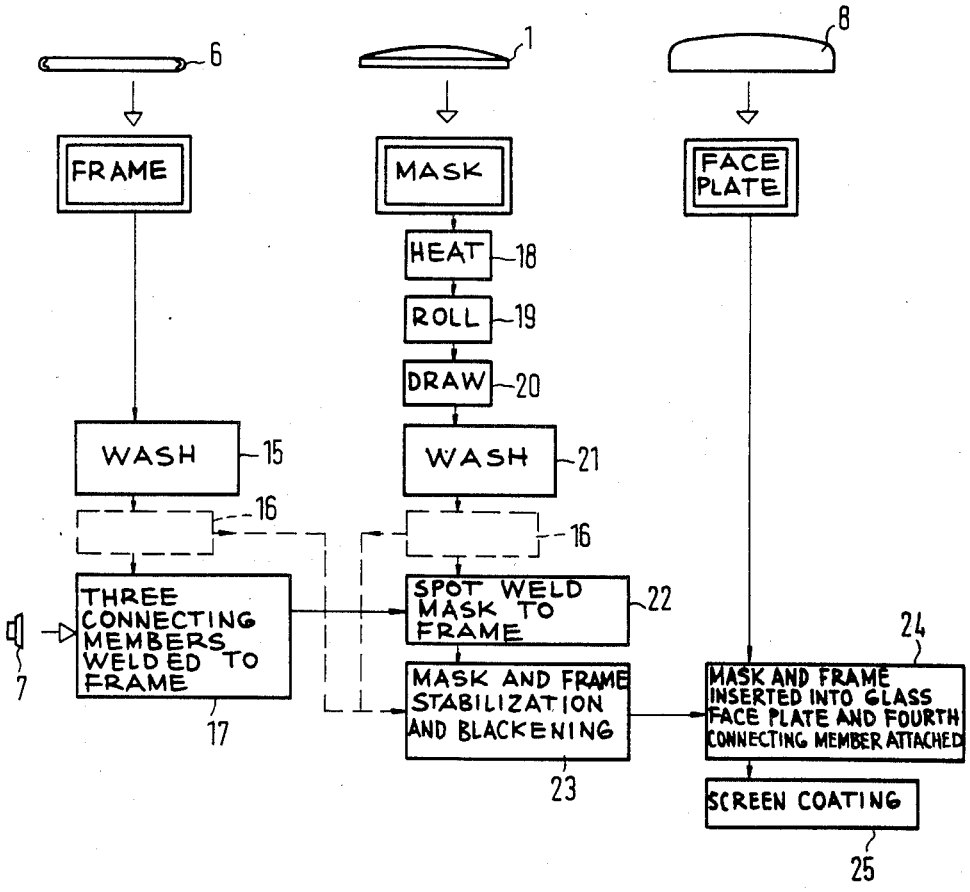
FIG. 6 shows a flowchart of the mask-frame manufacture according to the invention. The individual process steps are shown by rectangles.

Turning now to the unique method of assembly of the mask frame and faceplate, FIG. 6 shows that in Step 15, the frame is washed and degreased. According to the invention, blackening, Step 16, is performed together with the stabilizing of the welded parts 1, 6, and 7 in Step 23. In Step 17, three connecting members 7 are welded onto the frame. The mask 1 is first processed in the conventional manner by heating as shown in Step 18, rolling as shown in Step 19 and drawing as shown in Step 20. After the mask is washed as shown in Step 21, the mask 1 is secured by spot welding in Step 22. This is followed by the joint heat treatment for blackening and simultaneous stabilization, Step 23.

The assembled mask 1, frame 6, bimetallic spring holders 7*a* and mounting springs 7*b* are in Step 23 simultaneously surface-treated and thermally stabilized, with the treatment being carried out until the mask and the frame have reached a common final temperature $T_E$, and the heating up process being timed so that the maximum temperature difference between the frame and the mask is less than about $\frac{1}{3}$ of the final temperature $T_E$, which temperature is within the range of 500° to 600° C. and preferably 570° to 580° C. The mask frame assembly is blackened by the use of a generator gas in the furnace atmosphere so that surface treatment is accomplished simultaneously with the thermal stabilization. The passivation step may also include passivation in the presence of 2 to 3 percent oxygen. It is preferable that after the stabilization and surface treatment is accomplished, the cooling of the mask frame assembly be accelerated so that the temperature of the frame falls below $T_E/2$ within approximately four minutes so that the bimetal does not excessively change its properties. Step 24 designates the insertion into the glass faceplate 8 and the attachment of the fourth connecting member. The fabrication process then continues with the coating of the screen, Step 25.

Each of the connecting members 7 consists of a bimetallic-spring holder 7*a* and a mounting spring 7*b*. The fourth mounting spring is not welded on until after the simultaneous blackening and stabilizing process. All other welds can be made by spot welding prior to the blackening of the parts to be joined. This gives stronger welds and has the big advantage that there are hardly any splashes of welding flux which could settle in the apertures of the mask.

The process step hitherto required to stress-relieve the mask and the frame as well as the continuous furnace necessary therefor can be dispensed with because, in accordance with the invention, the maximum temperature during the blackening of the welded maskframe assembly is limited preferably to 580° C., and because this temperature acts on the mask only until the frame is at the same temperature. By narrowing down the process parameters, the deformations of the mask ("collapsing") and the frame distortion are kept so small (maximum dimensional variations: 0.3 mm) that they can be received by the mask-frame assembly in the elastic range within permissible limits. To compensate for the small amount of deformation referred to as "collapsing", i.e., to ensure the desired mask contour of the finished product, this remaining dimensional variation is allowed for in the design of the maskstamping die. The stress relief caused during the blackening of the welded mask-frame assembly results in sufficient aging of the metal parts. FIG. 6 shows how the "blackening-stabilizing" step is integrated in the sequences of operations for manufacturing the maskframe assembly. The rectangles 16 indicate where the blackening takes place in conventional fabrication processes, and the arrows indicate where this process step, hitherto performed separately for the mask and the frame, is now carried out as a single operation.

The simplification of and improvement on the prior art method is thus made possible by the design shown in FIGS. 1 to 5, particularly the design of the mask and the suitable choice of its dimensions and of the positions of the welds. The slightly curved mask 1 is designed to take strains in the elastic range which are caused during manufacture and operation, while deformations and changes of position are kept to a minimum. This is achieved by suitable choice of A, B, and C (see FIGS. 3 and 4) and by providing stress-relieving means in the form of indentations 10, cutouts 11, the circumferential groove 12, and the flange 13 ("skirt"), which serve to take strains. It is not always advantageous to make all welded joints; particularly those near the edges may be omitted under certain circumstances.

If the distances A, B, and C are chosen as claimed, and the joints are not too close together and too close to corners and edges, sufficient elasticity is ensured. Thus, by suitable choice of the positions of joints and stress-relief points, the displacement of the mask during manufacture and operation is kept so small that an improved and simplified sequence of operations is possible during the manufacture of the mask and the support frame.

What is claimed is:

1. A mask-frame assembly for a screen of a color television tube, comprising:

a mask in the form of a thin sheet of metal which contains a plurality of apertures;

a bent flange formed about the periphery of the mask;

a frame to which the mask flange is welded, wherein the nearest weld to the center of a long side of the mask is at a distance A from the center of the side where A is chosen so that $(D/4.5) \leqq = A \leqq = (D/2.4)$, and on a short side of the mask, a distance B between a weld and the nearest corner of the mask is chosen so that $(D/8.4) \leqq = B \leqq = (D/3.0)$, that a width C of the flange near an edge where the welds are located is chosen to be $C \geqq = (1.6D/100)$, where D is the length of the screen diagonal;

welds also being disposed at the corners of the mask;

stress-relief means disposed on both sides of the corner welds for relief of mechanical stress; and connecting members consisting of bimetallic-spring holders and mounting springs welded to said frame.

2. A mask-frame assembly as described in claim 1, wherein the stress-relief means are indentations.

3. A mask-frame assembly as described in claim 1, wherein the stress-relief means are cutouts.

4. A method of manufacturing a mask-frame assembly as described in claim 1, the parts of which are welded together, surface-blackened, and thermally stabilized, comprising the steps of:

attaching to the frame bimetallic-spring holders and mounting springs by welding;

spot welding the mask and the frame; and surface-treating and simultaneously thermally stabilizing as a unit the mask, frame, bimetallic-spring holders, and mounting springs, the thermal treatment being carried out until the mask and the frame have reached a common final temperature $T_E$, and the heating-up process being timed so that the maximum temperature difference between the frame and the mask is less than about $\frac{1}{3}$ of the common final temperature $T_E$ of 500° to 600° C. and that the mask-frame is blackened by the use of generator gas as the furnace atmosphere in the surface treatment effected simultaneously with the thermal stabilization.

5. A method as described in claim 4, wherein the mask-frame assembly is additionally passivated in the presence of 2 to 3% oxygen.

6. A method as described in one of claims 4 or 5, wherein after the stabilization and the surface treatment, the cooling of the mask-frame assembly is accelerated by suitable reduction of the heating power in the furnace and suitable choice of the time of removal from the furnace that the temperature of the frame falls below $T_E/2$ within about 4 minutes, so that the bimetal does not excessively change its properties.

7. A method as described in claim 4, wherein temperature $T_E$ is in the range of 570° to 580° C.

* * * * *

UNITED STATES PATENT AND TRADEMARK OFFICE

CERTIFICATE OF CORRECTION

PATENT NO. : 4,806,820

DATED : February 21, 1989

INVENTOR(S) : D. Berner et al

It is certified that error appears in the above-identified patent and that said Letters Patent is hereby corrected as shown below:

Claim 1, line 10, at each occurrence, please delete "=",
and at line 13, at each occurrence, please delete "=",
and at line 15, please delete "=".

Signed and Sealed this

First Day of August, 1989

*Attest:*

*Attesting Officer*

DONALD J. QUIGG

*Commissioner of Patents and Trademarks*